US006036102A

United States Patent [19]

Pearson

[11] Patent Number: 6,036,102

[45] Date of Patent: Mar. 14, 2000

[54] METHOD AND APPARATUS FOR ICE DAM PREVENTION

[76] Inventor: William J. Pearson, 2375 Camay La., Jamestown, N.Y. 14701

[21] Appl. No.: 09/130,689

[22] Filed: Aug. 6, 1998

[51] Int. Cl.[7] ..... F24F 11/053

[52] U.S. Cl. ..... 236/49.3; 52/199; 454/256; 454/343

[58] Field of Search ..... 454/239, 251, 454/253, 256, 258, 260, 338, 343; 236/49.3; 52/199

[56] References Cited

U.S. PATENT DOCUMENTS

| | | | |
|---|---|---|---|
| 4,251,026 | 2/1981 | Siegel et al. | 454/343 X |
| 4,507,929 | 4/1985 | Dozier | 62/79 |
| 4,776,385 | 10/1988 | Dean | 165/16 |
| 4,867,376 | 9/1989 | Arceneaux et al. | 236/49.2 |
| 4,949,902 | 8/1990 | Mills | 236/49.3 |
| 4,960,041 | 10/1990 | Kiser . | |
| 4,993,629 | 2/1991 | Wylie | 236/11 |
| 5,123,875 | 6/1992 | Eubank et al. | 454/342 |
| 5,147,244 | 9/1992 | Spilde | 454/364 |
| 5,257,736 | 11/1993 | Roy | 236/49.3 |
| 5,620,368 | 4/1997 | Bates et al. | 454/186 |

*Primary Examiner*—Harold Joyce
*Attorney, Agent, or Firm*—The Bilicki Law Firm, P.C.

[57] ABSTRACT

An apparatus for the prevention of ice dams on roofs of edifices comprising a ventilator, a first and second outdoor temperature sensor. The first temperature sensor is located outside where snow will not collect. The second outdoor temperature sensor is located on the roof of the edifice where snow will collect. Both sensors are housed to protect the sensors from extreme weather conditions, such as sun and wind. The apparatus also comprises a thermostat for receiving the temperature readings from the first and second temperature sensors and manipulating the ventilator. The apparatus also provides a method of preventing ice dam formation on roofs of edifices, comprising the steps of detecting a first temperature reading of the ambient atmosphere, detecting a second temperature reading of the roof of the edifice, comparing the readings to determine whether conditions exist for ice dam formation, ventilating an air space below the roof of the edifice to cool the roof if ice dam conditions are present.

3 Claims, 4 Drawing Sheets

METHOD AND APPARATUS FOR ICE DAM PREVENTION

FIELD OF THE INVENTION

This invention relates generally to preventing ice dam formation on the roofs of edifices. Specifically, the invention prevents ice dam formation by regulating the indoor temperature of the airspace closest to the roof of the edifice.

BACKGROUND OF THE INVENTION

Ice dams form when three conditions are present: 1) the roof surface temperature is above 32 degrees Fahrenheit ("°F."), 2) a blanket of snow is on the roof, and 3) the outside temperature is below 32° F. When these three conditions exist, the snow on the roof will melt and trickle to the edge of the roof where the snow will refreeze. As more snow melts, the refrozen water at the edge of the roof forms a dam. In geographic areas that receive many inches of snowfall per year, this problem is exacerbated. This is because the thick layers of snow acts as an insulation layer, trapping the heat closest to the roof.

Ice dams can cause serious damage to homes, such as, water stained ceilings & walls, deteriorated and dislodged roof surfaces, sagging or dislodged roof gutters, peeling paint due to trapped moisture, damaged plaster, smelly rotting wall cavities, decay of structural framing members, corroded metal fasteners, mold and mildew, and wet or damp insulation.

Previous solutions to this problem included reinsulating the home, ventilation, heat tape, ice belts, self-healing membranes, chopping the ice or shoveling the snow off the roof. The aforementioned solutions are not practical or inexpensive and do not work for an extended period of time, thereby necessitating the reapplication of the chosen method or the necessity of a different method causing further expense and inconvenience to the home owner.

DESCRIPTION OF THE PRIOR ART

Many United States patents describe the use of a ventilator to assist in controlling inside ambient temperatures and correcting conditions inside a structure or edifice, such as U.S. Pat. Nos. 4,776,385, 4,867,376, 4,993,629, and 5,620,368. However, none of these patents describe ventilating an airspace to correct conditions that exist outside the structure or edifice. In addition, none of the patents describe or teach the use of two outdoor temperature sensors to activate the ventilation of an indoor airspace.

SUMMARY OF THE INVENTION

An apparatus for the prevention of ice dams on roofs of edifices comprising a ventilator, a first and second outdoor temperature sensor. The first temperature sensor is located on a side of the edifice. The second outdoor temperature sensor is located on the roof of the edifice. The apparatus also comprises a thermostat for receiving the temperature readings from the first and second temperature sensors and manipulating the ventilator. Both sensors are housed to protect the sensors from extreme weather conditions, such as sun and wind.

A method of preventing ice dam formation on roofs of edifices, comprising the steps of detecting a first temperature reading of the ambient atmosphere, detecting a second temperature reading of the roof of the edifice, comparing the readings to determine whether conditions exist for ice dam formation, ventilating an air space below the roof of the edifice to cool the roof if ice dam conditions are present.

It is an object of the present invention to provide an easy to install and universally adaptable to any edifice system for preventing ice dam formation.

It is an additional object of the present invention to provide an inexpensive method of and apparatus for preventing ice dam formation.

It is a further object of the present invention to completely eradicate the formation of ice dams.

DETAILED DESCRIPTION OF THE PREFERRED EMBODIMENT

Figure 1:
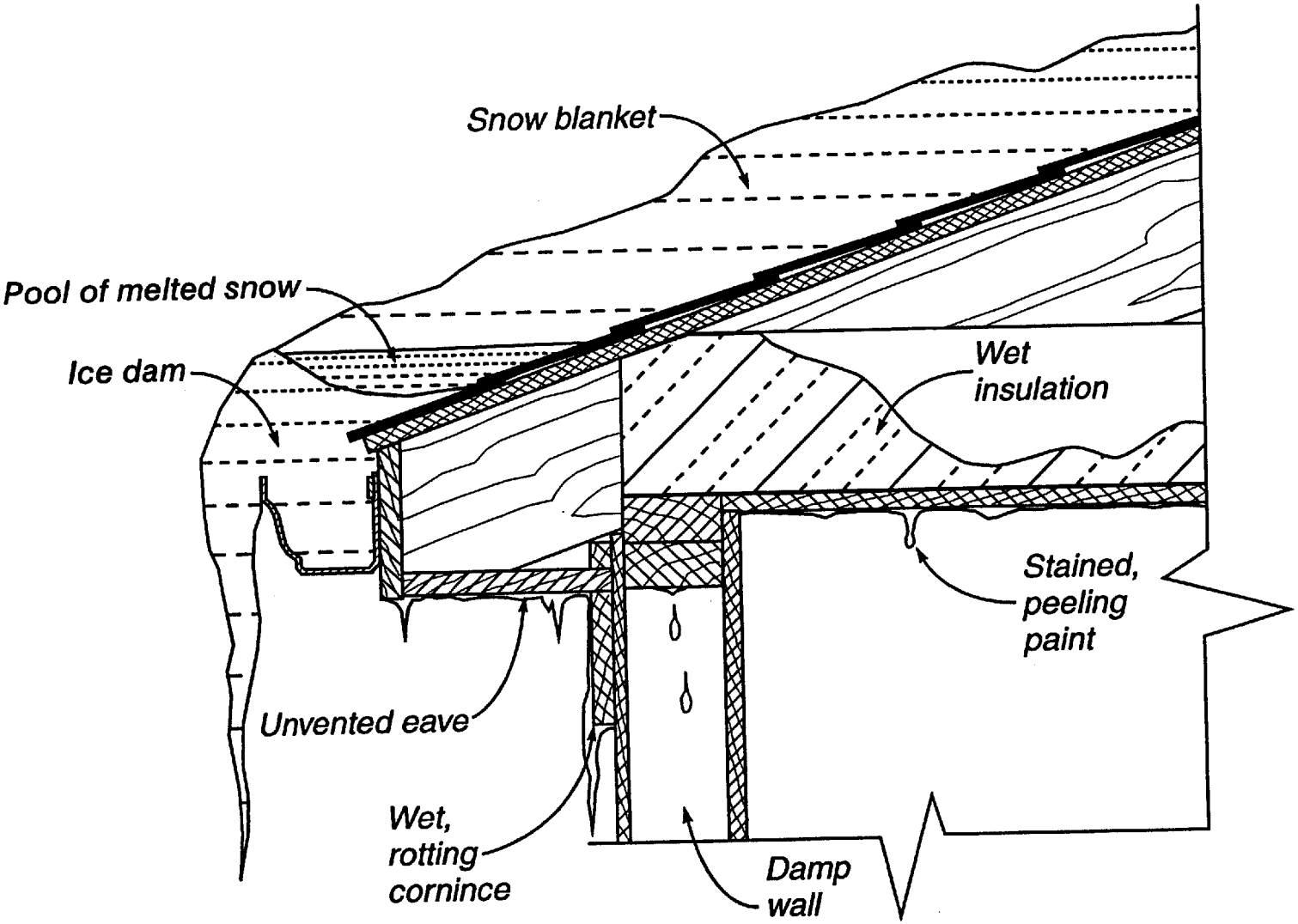
FIG. 1 illustrates the various problems that ice dams can create.
Figure 2:
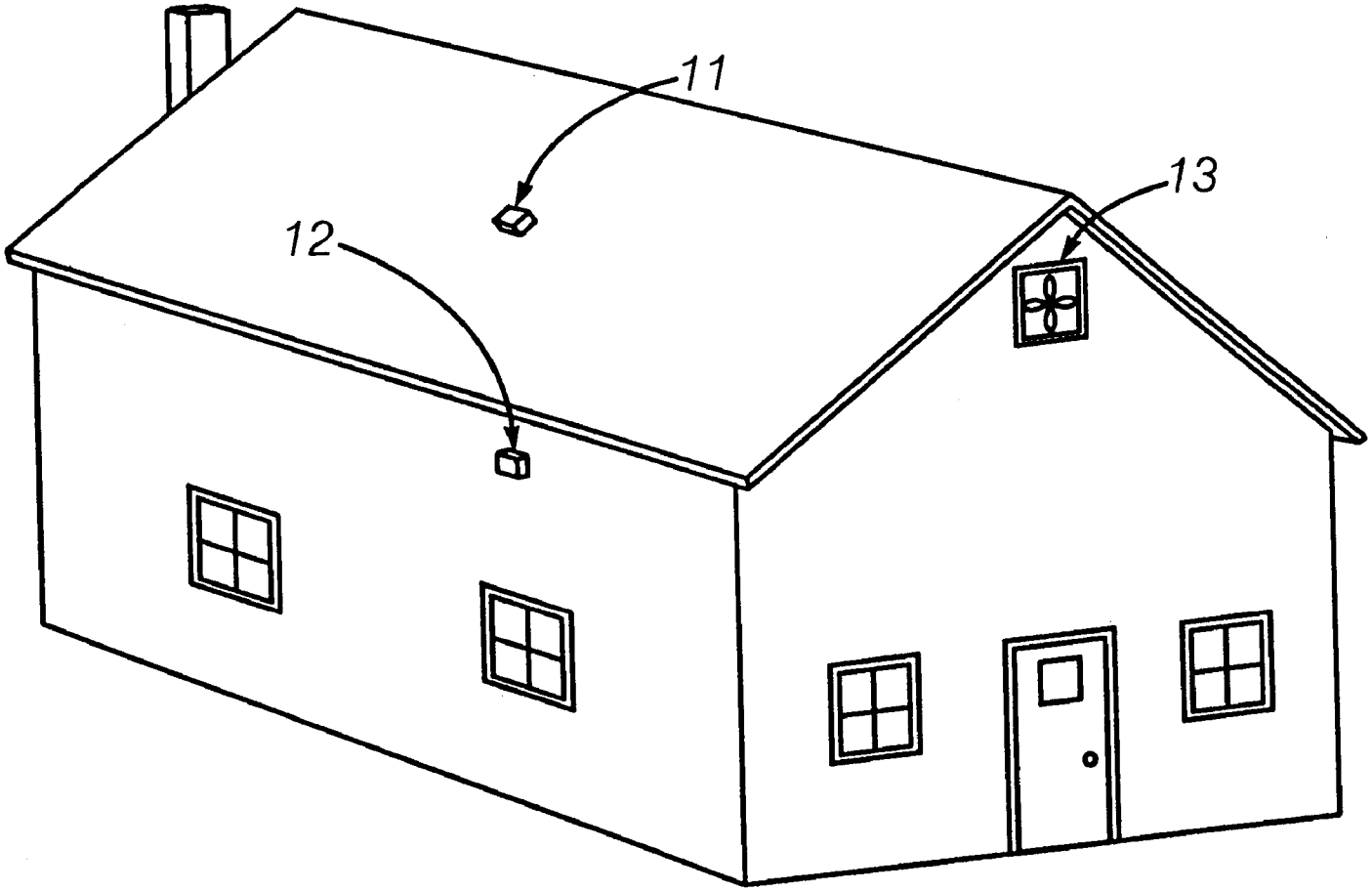
FIG. 2 is an aerial view of the preferred embodiment of the invention.

With reference to the drawings, FIG. 1 depicts the various problems that ice dams can cause inside and outside of a house or edifice. One can see from FIG. 1, the location of ice dam formation and the damage that can occur to not only the roof surface but the structure of the edifice as well. FIG. 2 depicts an overall view of an edifice and a suggested location for the temperature sensor.

Figure 3:
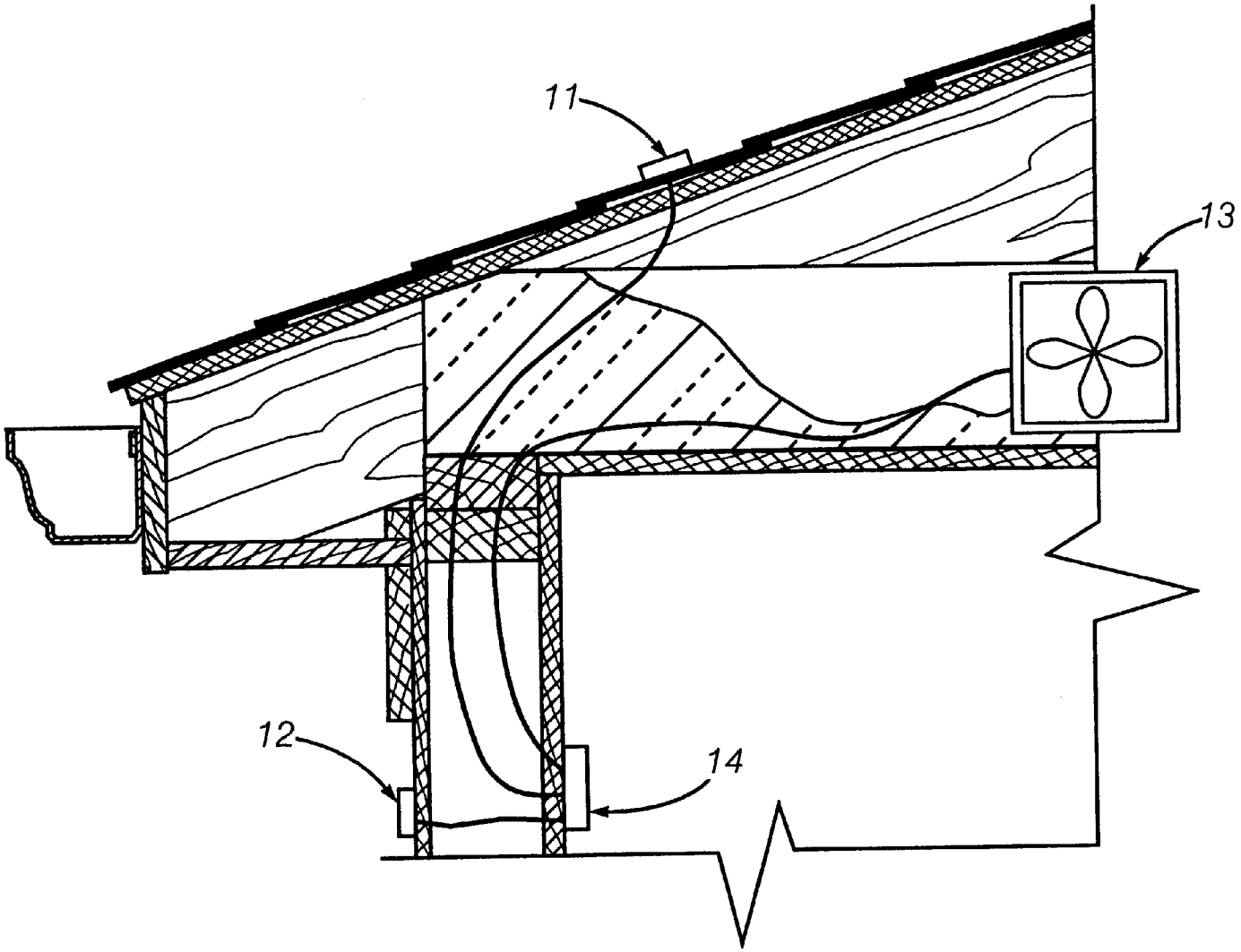
FIG. 3 is an overall view of the components of the invention.
Figure 4:
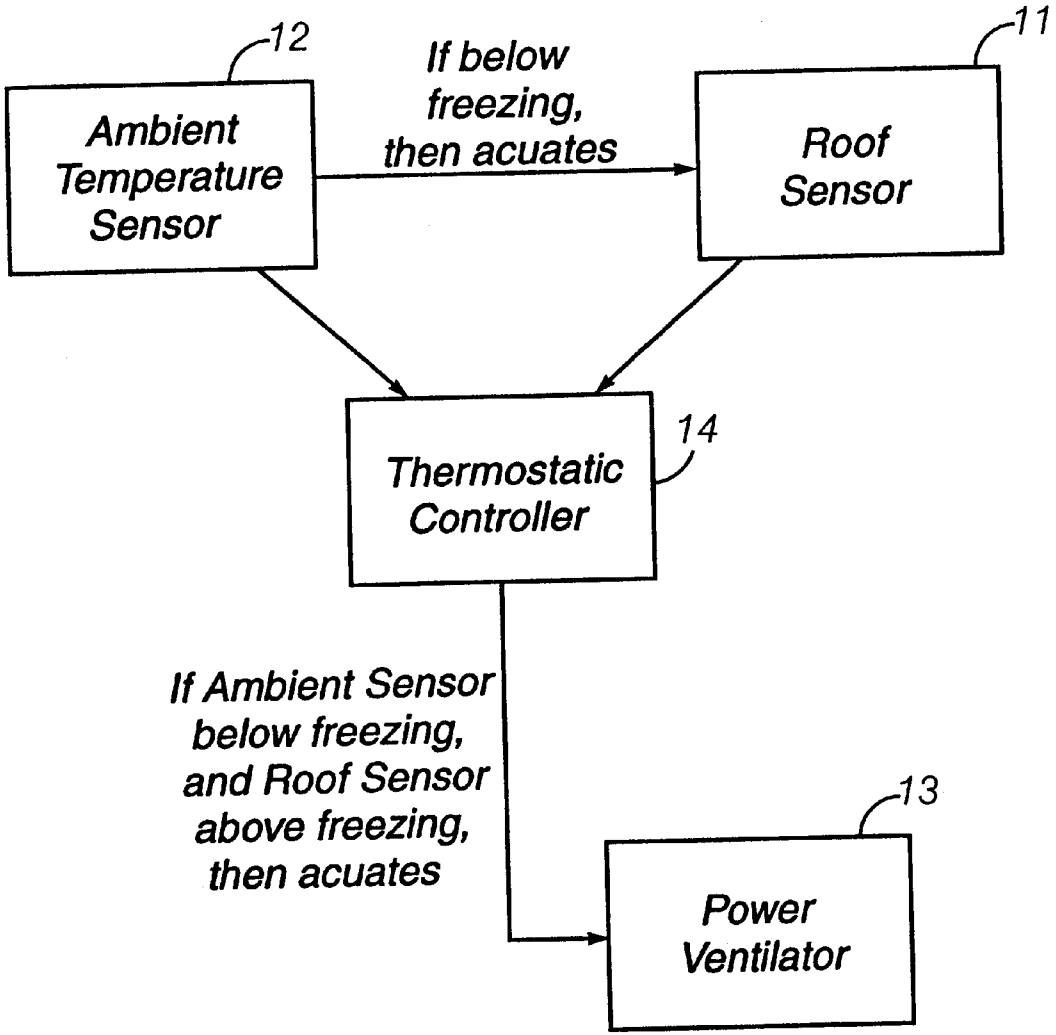
FIG. 4 is a flow chart depicting the flow of electronic information and actuation of the components of the invention.

In the preferred embodiment as depicted in FIGS. 3 and 4, the apparatus is comprised of a power ventilator (13); a thermostatic controller (14) or switch operatively connected to the ventilator; and two remote sensors (11 and 12) that are connected to the thermostatic controller. The first remote sensor (11) is mounted within a housing on the roof so that the first remote sensor measures the temperature of the roof surfaces. The first sensor (11) should be located so that it is in a location where snow will collect. The second remote sensor (12) is mounted outside the building where it will detect the outside ambient temperature and where snow will not collect. When the outside ambient temperature is below freezing, snow has collected on the roof, and the roof surface temperature is above freezing, melting occurs at the juncture of the roof surface and the first layer of snow. The melted water runs to the exposed edge of the roof where the melted water then turns to ice because the outside temperature is below freezing. This formation of ice grows until some mechanical damage to the roof surfaces and the structure of the edifice can occur from the ice dam itself. However, the more dangerous condition arises from the pool of melted water that collects behind the ice dam. This water builds up and then seeps into the roof surface and structure of the house or edifice causing serious damage to the structure. Therefore, when there is a layer of snow on the roof, the outside temperature is below freezing and the roof surface temperature is above freezing, a ventilator is powered which cools the space in the attic under the surface, thereby cooling the surface. Cooling the surface prevents any snow from melting that, in turn, prevents any ice formation.

The first and second temperature sensors are operatively connected to the power actuator of the ventilator. When the first sensor reads below 32° F. and the second sensor reads above 32° F., the sensors actuate the ventilator. The ventilator will remain running until the second sensor reads below 32° F. While reference is made to specific temperatures in this description of the preferred embodiment, it should be noted that sensors are sometimes not accurate and that placement on different areas of the roof of the edifice will lead to inaccuracies of temperature readings. Therefore, the owner of the edifice can change the optimum temperature that actuates the ventilator based on his/her experience with the temperatures at which ice dams form on the edifice. The claims of this patent application are, therefore, directed to ranges of temperatures at which ice dam formation can occur.

As one skilled in the art can appreciate, any number of temperature sensors as well as any ventilator and any actuator or temperature controller can be used to complete the objects of the invention while remaining within the scope and spirit of the claims of this application.

The method of the invention includes detecting when a blanket of snow exists on the roof. This can be done in any way that is practical; however, in the preferred embodiment, the detection step is optional. Once a blanket of snow is detected, the first temperature is detected to determine the outdoor ambient temperature. The second temperature is then detected to determine the temperature of the roof surfaces. The temperature readings are then compared to determine if the proper conditions exist for ice dam formation, i.e., that the ambient temperature is below 32° F. and the roof surface temperature is above 32° F. If the ice dam conditions do not exist, nothing is activated. If ice dam conditions do exist, the power ventilator is activated. The ventilator draws in outside air to cool the airspace. As the airspace underneath the roof cools, the roof surfaces will cool as well. The ventilator will remain running until the surface temperature falls below 32° F. While reference is made to specific temperatures in this description of the preferred embodiment, it should be noted that sensors are sometimes not accurate and that placement on different areas of the roof of the edifice will lead to inaccuracies of temperature readings. Therefore, the owner of the edifice can change the optimum temperature that actuates the ventilator based on his/her experience with the temperatures at which ice dams form on the edifice. The claims of this patent application are, therefore, directed to ranges of temperatures at which ice dam formation can occur.

Although the invention is described by reference to a specific preferred embodiment, it is clear that variations can be made without departing from the spirit of the invention as claimed.

What I claim is:

1. An apparatus for the prevention of ice dams on roofs of edifices, comprising:

a ventilator;

a first and second outdoor temperature sensor, said first temperature sensor located outside where snow will not collect;

said second temperature sensor located on the roof of the edifice where snow will collect;

a thermostat for receiving the temperature readings from the first and second temperature sensors and manipulating said ventilator.

2. An apparatus according to claim 1, comprising:

a thermostatic controller operatively controlling said ventilator;

said controller coupled to said thermostat and activating or deactivating said ventilator.

3. A method of preventing ice dam formation on roofs of edifices, comprising the steps of:

detecting a first temperature reading of the ambient atmosphere;

detecting a second temperature reading of the roof of the edifice;

comparing the readings to determine whether conditions exist for ice dam formation; and, ventilating an air space below the roof of the edifice to cool the roof if ice dam conditions are present.

* * * * *